US009951586B2

(12) United States Patent
Looijer et al.

(10) Patent No.: US 9,951,586 B2
(45) Date of Patent: Apr. 24, 2018

(54) METHOD AND SYSTEM FOR INHIBITING FREEZING OF LOW SALINITY WATER IN A SUBSEA LOW SALINITY WATER INJECTION FLOWLINE

(71) Applicant: SHELL OIL COMPANY, Houston, TX (US)

(72) Inventors: Mark Theodoor Looijer, Rotterdam (NL); Roald Arkesteijn, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/109,296

(22) PCT Filed: Dec. 23, 2014

(86) PCT No.: PCT/US2014/072025
§ 371 (c)(1),
(2) Date: Jun. 30, 2016

(87) PCT Pub. No.: WO2015/103017
PCT Pub. Date: Jul. 9, 2015

(65) Prior Publication Data

US 2016/0326847 A1 Nov. 10, 2016

(30) Foreign Application Priority Data

Jan. 3, 2014 (EP) ..... 14150141

(51) Int. Cl.
*E21B 34/06* (2006.01)
*E21B 37/06* (2006.01)
(Continued)

(52) U.S. Cl.
CPC ..... *E21B 43/01* (2013.01); *E21B 34/06* (2013.01); *E21B 37/06* (2013.01); *E21B 43/20* (2013.01)

(58) Field of Classification Search
CPC ..... E21B 34/06; E21B 37/06; E21B 43/01; E21B 43/20
See application file for complete search history.

(56) References Cited

U.S. PATENT DOCUMENTS 2,953,204 A * 9/1960 Doscher ..... E21B 23/10 166/266
7,395,864 B2 * 7/2008 Ramachandran ..... C09K 8/52 137/13

(Continued)

FOREIGN PATENT DOCUMENTS

WO 2010092095 8/2010
WO 2010092097 8/2010

(Continued)

*Primary Examiner* — Matthew R Buck

(57) ABSTRACT

A method for inhibiting freezing of low salinity water ($H_2O$) in a subsea low salinity water injection flowline comprises providing the flowline with a pressure control system, which may include a high pressure pump and a pair of pressure shut in valves, which maintains an elevated fluid pressure within the flowline throughout low salinity water injection operations and shut in periods, during which periods the flowline remains filled with pressurized non frozen low salinity water ($H_2O$) that may have a temperature of about −2 degrees Celsius.

11 Claims, 1 Drawing Sheet

(51) Int. Cl.
*E21B 43/20* (2006.01)
*E21B 43/01* (2006.01)

(56) References Cited

U.S. PATENT DOCUMENTS

| | | | | |
|---|---|---|---|---|
| 7,455,109 | B2 * | 11/2008 | Collins | C09K 8/528 166/266 |
| 7,600,567 | B2 * | 10/2009 | Christopher | B01D 61/025 166/263 |
| 8,813,854 | B2 * | 8/2014 | Sahni | E21B 43/16 166/263 |
| 9,528,350 | B2 * | 12/2016 | Lunde | C02F 1/686 |
| 2004/0244980 | A1 * | 12/2004 | Appleford | E21B 43/18 166/305.1 |
| 2009/0194272 | A1 * | 8/2009 | Baillie | B01D 61/022 166/90.1 |
| 2012/0090833 | A1 | 4/2012 | Ligthelm et al. | |
| 2014/0112803 | A1 * | 4/2014 | Hallset | E21B 41/0007 417/53 |

FOREIGN PATENT DOCUMENTS

| | | |
|---|---|---|
| WO | 2012051511 | 4/2012 |
| WO | 2013117741 | 8/2013 |

* cited by examiner

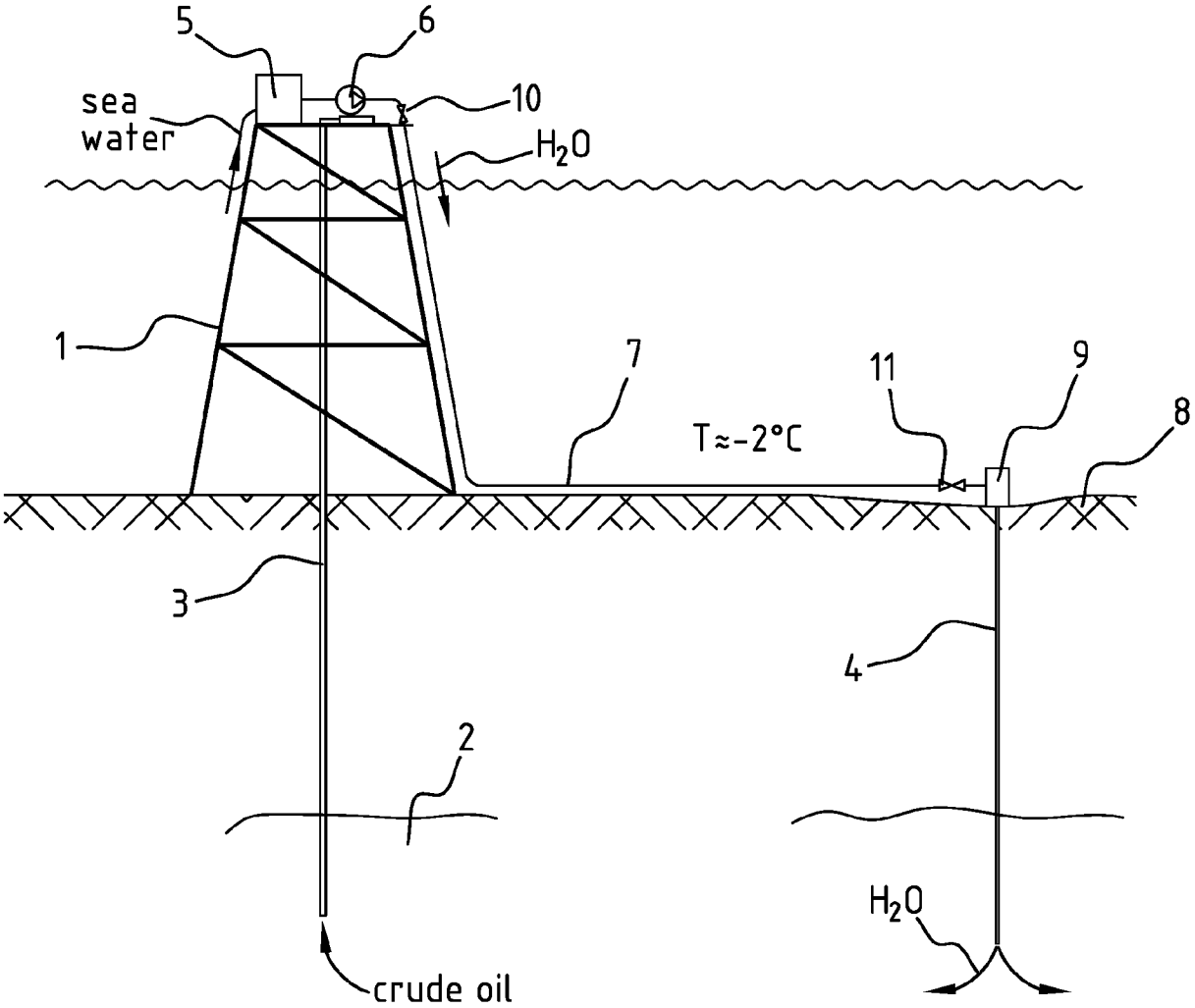
sea water
5
6
10
$H_2O$
1
7
T≈-2°C
11
9
8
3
2
crude oil
4
$H_2O$

METHOD AND SYSTEM FOR INHIBITING FREEZING OF LOW SALINITY WATER IN A SUBSEA LOW SALINITY WATER INJECTION FLOWLINE

CROSS-REFERENCE TO RELATED APPLICATIONS

The present application is a National Stage (§ 371) of International Application No. PCT/US2014/072025, filed Dec. 23, 2014, which claims priority from European Application No. 14150141.1, filed Jan. 3, 2014, the disclosures of each of which are hereby incorporated by reference in their entirety.

BACKGROUND OF THE INVENTION

The invention relates to a method and system for inhibiting freezing of low salinity water in a subsea low salinity water injection flowline.

It is known from International patent applications WO 2012/051511, WO 2010/092097 and WO2010/092095 to Enhance Oil Recovery (EOR) by injecting desalinated water into an oil containing formation.

At offshore locations the low salinity water may be obtained by desalinating seawater at an offshore platform and then injecting the desalinated water flux through a subsea water injection flowline to a subsea wellhead of subsea desalinated water injection well.

In arctic and deepwater environments the ambient seawater temperature at the seabed may be −2 degrees Celsius. At this subzero temperature the seawater surrounding the subsea flowline does not freeze, but the desalinated injection water in the subsea injection flowline, which has a freezing point of about 0 degrees Celsius, may freeze and plug and rupture, in particular if the flux of low salinity water would temporarily stop, for example due to an injection process upset.

Upon melting, the flowline contents would spill into the sea and the flowline would require replacement causing production deferment and unplanned expenditure.

Known solutions to prevent freezing of subsea flowlines involve flowline heating, insulation and/or injection of anti-freeze additives, which are costly both installation-wise and operation-wise and require a active flowline monitoring and/or anti-freeze injection systems that are prone to malfunctioning. A potential platform black-out is one scenario where not only the desalinated water injection would stop, but where the heating and/or anti-freeze injection would stop as well.

There is a need for an improved method and system for inhibiting freezing of subsea desalinated water injection flowlines which are cost effective and less vulnerable to malfunctioning than available flowline heating, insulation and anti-freeze injection systems.

SUMMARY OF THE INVENTION

In accordance with the invention there is provided a method for inhibiting freezing of low salinity water in a subsea low salinity water injection flowline, the method comprising providing the flowline with a pressure control system which maintains an elevated fluid pressure within the flowline throughout low salinity water injection operations and temporary flowline shut in periods during which the flowline remains filled with substantially stationary low salinity water.

The pressure control system may be configured to maintain the pressure within the flowline above 200 Bar, and optionally above 250 Bar, throughout the injection operations and the shut in periods and may thereto comprise:

- a pump that injects low salinity water at the elevated pressure into the flowline during low salinity injection operations;
- an upstream shut in valve arranged adjacent to an upstream end of the subsea flowline;
- a downstream shut in valve arranged adjacent to a downstream end of the flowline; and
- means for initially closing the downstream valve and subsequently the upstream valve prior to deactivating the pump at the beginning of each shut in period.

In accordance with the invention there is furthermore provided a system for inhibiting freezing of low salinity water in a subsea low salinity water injection flowline, the system comprising a pressure control system which is configured to maintain an elevated fluid pressure within the flowline throughout low salinity water injection operations and temporary flowline shut in periods during which periods the flowline remains filled with substantially stationary low salinity water.

The upstream and downstream shut in valves may be block valves and the pressure control system may furthermore comprise a pressure sensing gauge which gives an alarm signal when the pressure within the flowline drops below a predetermined pressure.

Furthermore the desalinated water injection flowline may be configured to inject desalinated seawater into a subsea oil containing formation to Enhance Oil Recovery (EOR) from the formation.

These and other features, embodiments and advantages of the method and system according to the invention are described in the accompanying claims, abstract and the following detailed description of non-limiting embodiments depicted in the accompanying drawing, in which description reference numerals are used which refer to corresponding reference numerals that are depicted in the drawing.

BRIEF DESCRIPTION OF THE DRAWING

FIG. 1 shows a subsea desalinated water injection flowline in which freezing of desalinated water is inhibited in accordance with the method and system according to the invention.

DETAILED DESCRIPTION OF THE DEPICTED EMBODIMENT

FIG. 1 shows an offshore oil production platform 1 for the production of crude oil from a subsea crude oil containing formation 2.

The crude oil is produced via one or more crude oil production wells 3 and to stimulate crude oil production low salinity water ($H_2O$) is injected into the formation 2 via a low salinity water injection well 4.

The injected low salinity water ($H_2O$) is obtained by desalinating seawater in a water desalination plant 5 at the oil production platform 1 and injecting the desalinated water ($H_2O$) into the injection well using a pump 6 and a subsea desalinated water injection flowline 7 that extends along the seabed 8 from a foot of the platform 1 to the wellhead 9 of the injection well 4.

The system according to the invention is furthermore equipped with an upstream shut in valve 10 and a downstream shut in valve 11, which are configure to be closed prior to shutting off the pump 6 at the end of a desalinated water injection cycle.

The closing of the shut in valves 10 and 11 prior to shutting off the pump 6 generates a pressure control system that is able to maintain a high enough pressure in the flow line 7 such that the freezing point of the desalinated water ($H_2O$) drops to/below the ambient seawater temperature. For −2 degrees Celsius ambient seawater temperature at the seabed, this requires a minimum of −395.2*(((273.16−2)/273.16)^9−1)=25.3 MPa=253 bar pressure to be maintained in the seabed desalinated water injection flow line 7.

In many cases, this effectively means that during shut-in periods, when injection of desalinated water ($H_2O$) is interrupted, the pressure of desalinated water ($H_2O$) within the injection flowline 7 is maintained at or near the pressure at which desalinated water ($H_2O$) is injected to the subsea wellhead 9.

The shut in valves 10 and 11 may consist of a set of block valves on either end of the flowline 7 that automatically shut in the pressure once the flux of desalinated water through the flowline 7 is interrupted, for example due to a trip of the injection pump 6.

To avoid freezing of the subsea flowline 7 in case the flow is interrupted for a longer period of time, say more than a day or a week, the flowline 7 may be drained and filled with a fluid that does not freeze at the ambient subzero seabed temperature. This fluid may comprise seawater or desalinated water to which an antifreeze additive, such as methanol and/or Mono Ethylene Glycol (MEG), is added.

The invention claimed is:

1. A method for inhibiting freezing of water in a subsea water injection flowline, the method comprising providing the flowline with a pressure control system which maintains a pressure within the flowline above 200 Bar throughout water injection operations and temporary flowline shut in periods during which periods the flowline remains filled with substantially stationary water, wherein the pressure control system comprises:

a pump that injects water into the flowline during the injection operations;

an upstream shut in valve arranged adjacent to an upstream end of the subsea flowline; and a downstream shut in valve arranged adjacent to a downstream end of the flowline, wherein the downstream shut in valve and the upstream shut in valve are configured to be closed prior to deactivating the pump at the beginning of the shut in periods.

2. The method of claim 1, wherein the pressure control system maintains the pressure within the flowline above 250 Bar throughout the injection operations and the shut in periods.

3. The method of claim 1, wherein the upstream and downstream shut in valves are block valves.

4. The method of claim 1, wherein the pressure control system furthermore comprises a pressure sensing gauge which gives an alarm signal when the pressure within the flowline drops below a predetermined pressure.

5. The method of claim 4, wherein the pressure sensing gauge is connected to the pump and upstream valve and is configured to restart the pump to start and to open the upstream valve when the pressure drops below the predetermined pressure during a shut in period and to close the upstream valve and subsequently stop the pump when the pressure sensing gauge indicates that the pressure in the flowline has again reached the predetermined pressure.

6. The method of claim 1, wherein the flowline is configured to inject desalinated seawater into a subsea oil containing formation to Enhance Oil Recovery (EOR) from the formation.

7. A system for inhibiting freezing of water in a subsea water injection flowline, the system comprising a pressure control system which is configured to maintain a pressure within the flowline above 200 Bar throughout water injection operations and temporary flowline shut in periods during which the flowline remains filled with substantially stationary water, wherein the pressure control system comprises:

a pump that injects water into the flowline during the injection operations;

an upstream shut in valve arranged adjacent to an upstream end of the subsea flowline; and a downstream shut in valve arranged adjacent to a downstream end of the flowline, wherein the downstream shut in valve and the upstream shut in valve are configured to be closed prior to deactivating the pump at the beginning of the shut in periods.

8. The method of claim 7, wherein the pressure control system is configured to maintain the pressure within the flowline above 250 Bar both during the injection operations and the shut in periods.

9. The system of claim 7, wherein the upstream and downstream shut in valves are block valves.

10. The system of claim 7, wherein the pressure control system furthermore comprises a pressure sensing gauge which gives an alarm signal when the pressure within the flowline drops below a predetermined pressure.

11. The system of claim 10, wherein the pressure sensing gauge is connected to the pump and upstream valve and configure to restart the pump to start and to open the upstream valve when the pressure drops below the predetermined pressure during a shut in period and to close the upstream valve and to subsequently stop the pump when the pressure sensing gauge indicates that the pressure in the flowline has again reached the predetermined pressure.

* * * * *